United States Patent [19]

Teel

[11] 4,281,503

[45] Aug. 4, 1981

[54] SAFETY STIRRUP

[76] Inventor: Kenneth D. Teel, Rte. 2, Box 48, Melrose, N. Mex. 88124

[21] Appl. No.: 76,928

[22] Filed: Sep. 19, 1979

[51] Int. Cl.[3] ..... B68C 3/02

[52] U.S. Cl. ..... 54/49

[58] Field of Search ..... 54/46, 47, 48, 49, 49.5

[56] References Cited

U.S. PATENT DOCUMENTS

| | | | |
|---|---|---|---|
| 453,607 | 6/1891 | Baker | 54/47 |
| 459,291 | 9/1891 | Johnson et al. | 54/49 |
| 478,633 | 7/1892 | Peacock | 54/49 |

*Primary Examiner*—Gene Mancene
*Assistant Examiner*—Robert P. Swiatek
*Attorney, Agent, or Firm*—Harvey B. Jacobson

[57] ABSTRACT

A curved side piece is fixedly attached to any stirrup strap and depends therefrom. One end of the tread is attached to the side piece and terminates in an unsupported free end. A retaining dome or wash rises up from the free end of the tread and has a smoothly curved inner boot contacting surface which retains the rider's foot but slopes away from his foot on all sides so as to minimize the chance of catching or hanging the foot, footwear or trousers leg in a fall. A retaining strap is pivotally attached to the top of the dome and slidably engaged with a cooperating member on the stirrup strap. In the event of a fall, the top of the retaining strap becomes disengaged thus allowing the foot to be freely released from the stirrup.

6 Claims, 10 Drawing Figures

Fig. 5
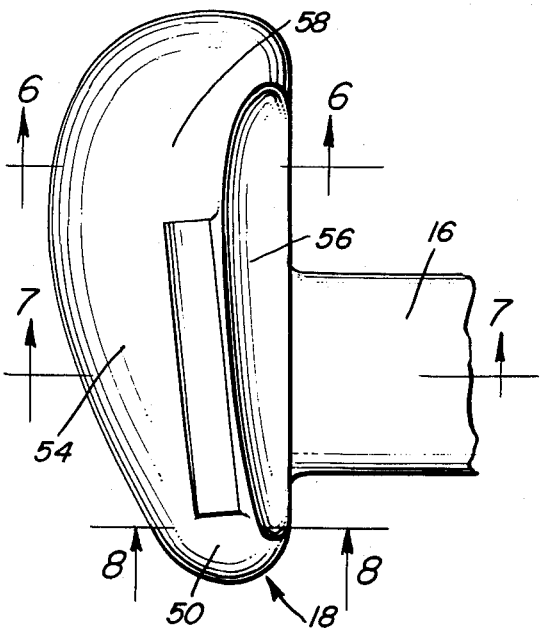
Fig. 6
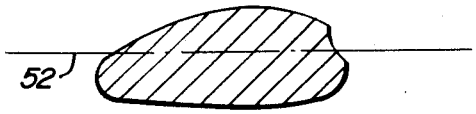
Fig. 7
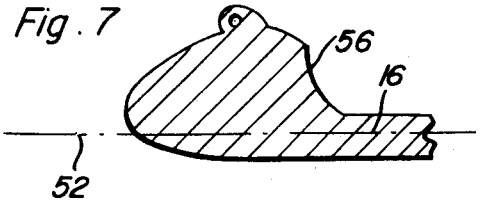
Fig. 8
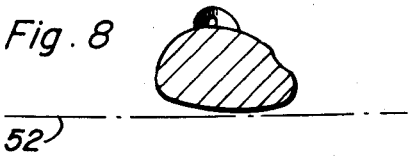
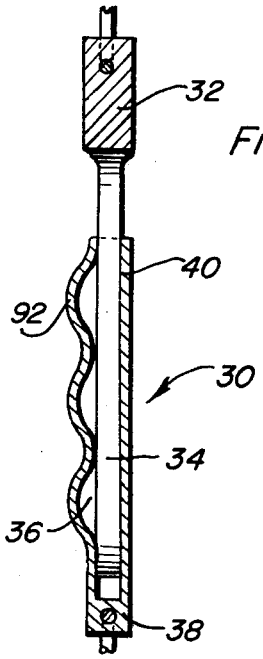
Fig. 9
Fig. 10
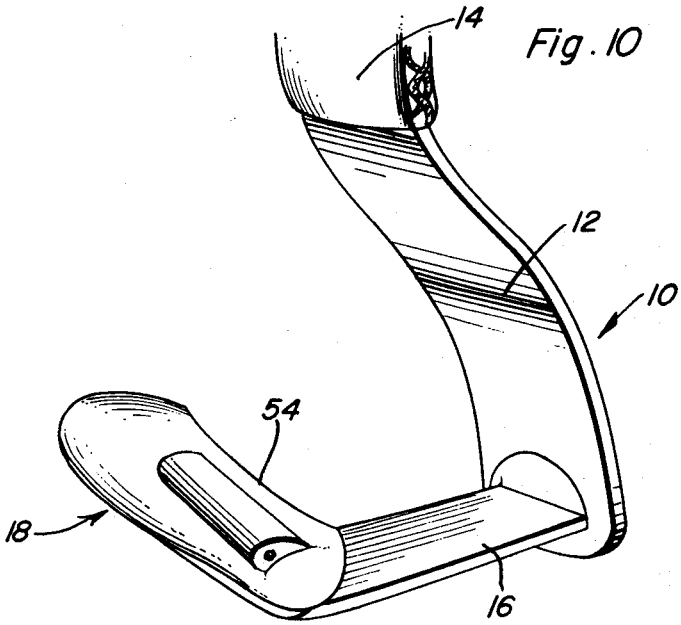

SAFETY STIRRUP

BACKGROUND OF THE INVENTION

1. Field of the Invention

This invention relates to improvements in stirrups and especially to such improvements which provide a high degree of safety to a rider that has inadvertently fallen from a horse.

2. Discussion of Related Art

When pursuing equestrian activities, it is well-known that one of the greater risks involved is injury which can result from being thrown or falling from a horse. Often such injury results from the fact that a rider is unable to disengage one of his feet from a stirrup. In this event the rider can be dragged or trampled by the animal.

Consequently, several stirrups have been suggested which are designed to minimize the probability of such injury. For instance, U.S. Pat. No. 13,240, issued July 10, 1855, to Vosmus shows an open stirrup for saddles having a slightly curved shank connected to a foot support portion with a guard on the outside thereof which is slightly raised to prevent the foot from sliding from its place. U.S. Pat. No. 203,807, issued May 14, 1878, to Wilson, shows an open stirrup which is open on one side and provided on the other side with an upwardly extending arm in which the stirrup strap is attached. U.S. Pat. No. 259,101, issued June 6, 1882, to Cox, shows a safety stirrup consisting essentially of a bracket having a hinged spring rod, the point of which enters an opening in the footrest, from which it will be disengaged by the foot of the rider should he be thrown. U.S. Pat. No. 1,074,481, issued Sept. 30, 1913, to Ward, shows a safety stirrup comprising a channeled tread, the flanges of which extend downwardly and having its outer end swagged upwardly to form a stop shoulder. A folding arm is pivotally connected with the channeled tread. A spring is connected to the folding arm and biases it against the stop shoulder formed on the tread. U.S. Pat. No. 3,555,781, issued Jan. 19, 1971, to Osborn, shows a safety stirrup comprising an L-shaped body having a substantially horizontal stirrup tread with a free, unsupported end and a shank affixed at the opposite end. The unsupported end is provided with a process in the form of a perpendicular lip for confining a rider's foot against lateral accidental removal from the stirrup.

SUMMARY OF THE INVENTION

One object of the present invention is to provide a safety stirrup which provides maximum rider safety in the event that a rider falls or is thrown from his horse, yet is relatively simple in construction and inexpensive to manufacture.

A further object of the present invention is to provide a safety stirrup which has a curved boot retaining dome which is effective in preventing lateral movement of the rider's foot from the stirrup yet affords only small resistance to removal of the foot in the case of an accidental fall.

Yet a still further object of the present invention is to provide a safety stirrup which includes a retaining strap which will aid in maintaining the rider's foot within the stirrup but which will disengage to freely release the rider's foot in case of an accidental fall.

In accordance with the above objects, the safety stirrup of the present invention includes a side piece having an upper end which is attached to the stirrup strap of a saddle. The side piece supports the entire stirrup in a dependent manner from the strap. The side piece curves outwardly and is connected at its bottom to a laterally extending tread which supports the boot of a rider. The opposite end of the tread is connected to an upwardly projecting dome or wash which serves to inhibit lateral motion of the boot of a rider when engaged with the stirrup. The back of the dome conforms to and helps restrain rider's heel on the stirrup. It also slopes away from the rider's foot in all directions to form a smooth curved surface which prevents the heel from being caught. The center section of the dome rises up from and is attached to the tread to retain the sole and side of the rider's foot. From the point of attachment, the center of the dome slopes smoothly away from the foot and curves around to a position coincident with the bottom of the tread. The front of the dome widens and slopes both downwardly and away from the rider's foot with the major portion of the dome front positioned below the level of the stirrup tread to enable the rider's foot to slide over the top of the dome during a twisting fall.

A retaining strap is pivotally mounted to the top of the dome and extends upwardly into engagement with the stirrup strap. Engagement is made with the stirrup strap through a safety link mechanism comprising cooperating ribbed male and recessed female members. The ribbed male member is inserted into the female member to engage the ribs and recesses. During an accidental fall from the saddle, the rider's foot will tug on the safety strap thus pulling apart the male and female members while the curved dome allows the rider's foot to fall free from the stirrup to avoid injury.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is a top plan view of the dome.

FIG. 6 is an end elevational sectional view taken substantially along a plane passing through section line 6—6 of FIG. 5.

FIG. 7 is an end elevational sectional view taken substantially along a plane passing through section line 7—7 of FIG. 5.

FIG. 8 is an end elevational sectional view taken substantially along a plane passing through section line 8—8 of FIG. 5.

FIG. 9 is an elevational sectional view taken substantially along a plane passing through section line 9—9 of FIG. 1.

FIG. 10 is a perspective view of the safety stirrup shown in use without the retaining strap and safety link.

DESCRIPTION OF THE PREFERRED EMBODIMENTS

Figure 1:
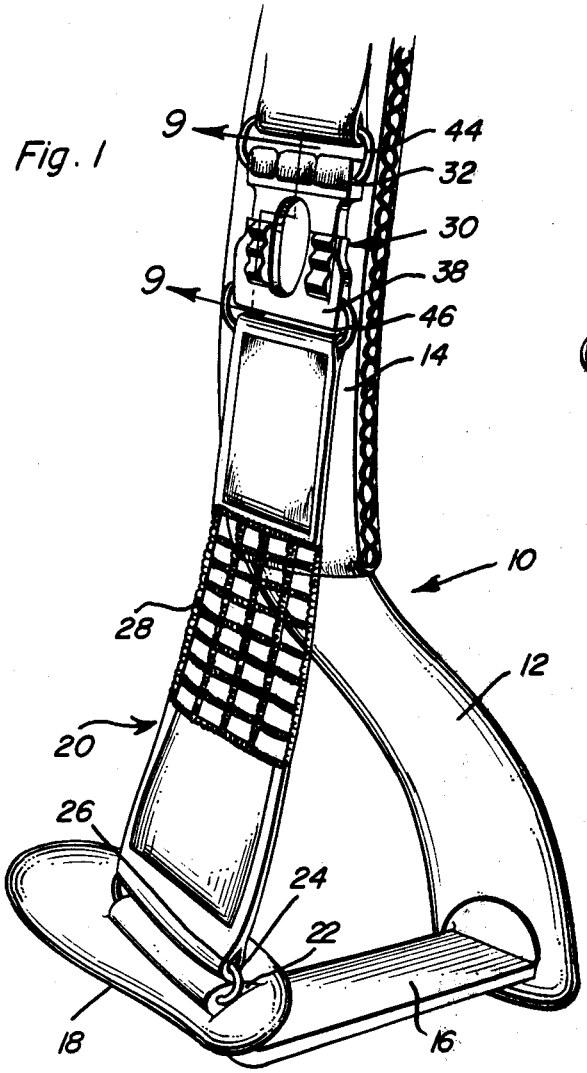
FIG. 1 is a perspective view of the safety stirrup of the present invention.
Figure 2:
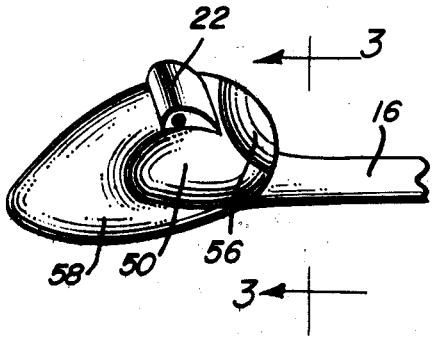
FIG. 2 is a fragmental rear elevational view showing the dome of the safety stirrup.

Now with reference to the drawings, a safety stirrup incorporating the principles and concepts of the present invention and generally referred to by the reference numeral 10 will be described in detail. The stirrup includes a side member 12 the top of which is fixedly attached to stirrup strap 14 which is an integral part of a saddle. Side member 12 is connected at its lower end to tread 16 of the stirrup. The side member bends inwardly of the stirrup as it extends upward from the tread to a position approximately medially of the tread in order to give the stirrup proper balance when it hangs from the strap 14. At the unsupported end of tread 16 is the wash or dome 18. The primary function of dome 18 is to retain the foot of the rider on the tread by preventing it from slipping sideways off the tread. If the rider should inadvertently lift his foot slightly from the tread and move it sideways, a retaining strap 20 is provided to retain the rider's foot within the confines of the stirrup.

Figure 4:
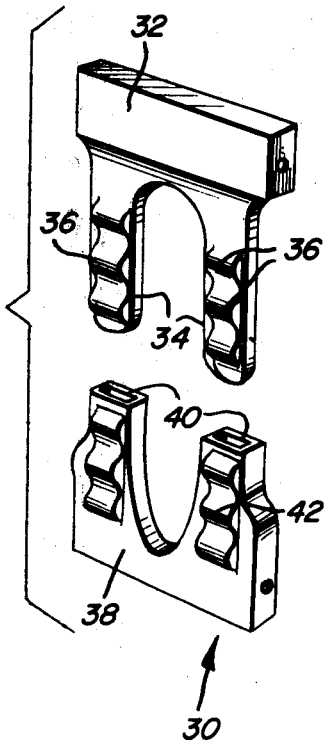
FIG. 4 is an exploded view showing the elements of the safety link.
Figure 3:
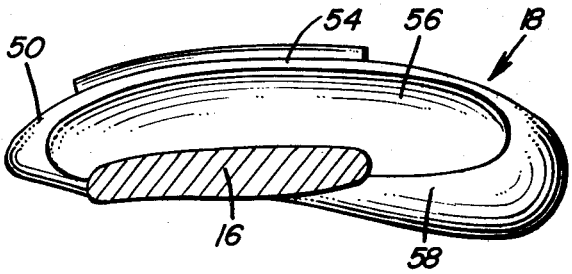
FIG. 3 is a side elevational sectional view taken substantially along a plane passing through section line 3—3 of FIG. 2.

The retaining strap 20 is permanently attached to the top of the dome 18 through a pivot connection comprising a raised boss 22 formed on the dome. The boss 22 has a curved wire connector 24 extending through it and through the lower portion of the retaining strap at 26. Accordingly, if the top of the retaining strap is free, the entire retaining strap can fall down about the pivot joint thus leaving the side of the stirrup open. The retaining strap is shown to be formed with solid upper and lower sections interconnected by a web 28. However, any suitable material for forming the retaining strap could be used, as desired. The upper section of the retaining strap is held against the stirrup strap 14 through the use of a safety link 30. Safety link 30, shown in FIGS. 1, 4 and 9, contains two separate components. A male or inserter component 32 has a pair of tongues 34 which project downwardly therefrom. Each tongue 34 contains a plurality of transverse ribs or bulges 36. The female or receiver portion 38 contains a pair of openings 40 each of which has a plurality of recesses 42 formed from plastic, spring steel, or other resilient material. The recesses 42 are equal in number to the ribs 36 and complement those ribs in shape for receiving the ribs. Obviously, in use, the tongues 34 are inserted into the openings 40 and the ribs 36 engage recesses 42 to provide a sliding engagement between the male and female portions. The strength of the engagement can be adjusted according to the number of ribs 36 inserted into the openings 40. For minimum strength, for example, only one rib would be inserted into each opening. One of the members 32, 38, is attached to the stirrup strap 14 and the other is attached to the retaining strap 20. As shown in FIG. 1, the male portion is attached to the stirrup trap 14 through the use of a flexible coupling comprising curved wire 44 which passes through an opening in the male portion 32 and through a section of the stirrup strap. In like manner, the female portion 38 is flexibly attached to the retaining strap 20 through the use of curved wire 46. Obviously, if the rider is inadvertently thrown or falls from the horse, the pressure of his foot against the retaining strap would be sufficient to cause a disengagement of portions 32 and 38 thus leaving the top of the retaining strap free to fall past the dome 18. The entire strap would thus pivot about boss 22 leaving the side of the strap open for removal of the rider's foot so that it will not become entrapped and injury will be avoided.

To further insure that the rider's foot will not become stuck in the stirrup, the dome 18 is designed to allow the foot to easily twist from the confines of the stirrup. With particular reference to FIGS. 1 through 3 and 5 through 8, it will be seen that the dome extends beyond the front and beyond the rear of the tread 16. The rear part of the dome, generally designated by the reference numeral 50, is positioned with its lowest point slightly above the center line of the tread shown by dotted line 52 in FIGS. 6 through 8. The rear portion 50 is smoothly curved away from its contact point with the rider's foot in both plan and in elevation as is clearly depicted in the figures. Accordingly, it is capable of providing lateral support to the rider's foot to help restrain the heel of the foot but at the same time will allow the foot to slide past in the event of an accident.

The center portion of the dome, generally referred to be the reference numeral 54, is directly attached to the tread 16 and rises perpendicularly to the tread to retain the sole and the side of the rider's foot. An indentation, shown generally at 56, is formed in the central portion of the dome and extends slightly into the forward and rear sections of the dome. The indentation is designed to conform to a rider's boot so as to hold the boot laterally on the tread 16. From the top of the indentation, the center portion of the dome slopes away from the tread and downwardly curving around and finally forming the bottom portion of the tread.

The forward portion of the dome, generally referred to by the reference numeral 58 widens and slopes downward and away from the rider's foot with the majority of that portion positioned below the center line of the tread 16. Accordingly, if the rider were to fall from his saddle, the twisting motion of his foot would not cause it to be caught on the forward portion. The rider's foot would merely be forced up over the top of the dome and free from the stirrup.

The dome 18 can be used on a stirrup with a retaining strap 20 as shown in FIG. 1. Or, alternatively, the dome 18 can be used without the retaining strap as shown in FIG. 10. In either case, the stirrup provides an effective foothold for the rider which is safe and minimizes the catching of the rider's clothing or foot gear, thus allowing the rider to drop free rather than be dragged by the animal in the event of an accidental fall. The same basic design of the safety stirrup can be used on either the right or left hand side of the saddle, with the opening of the stirrup with or without the retaining strap either against the horse's side or positioned opening away from the horse's side. In either event, the side dome prevents the rider's boot or foot from wedging into the stirrup, thus allowing the rider to drop free.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A stirrup having a side piece including an upper end and a lower end, said upper end being connected to a stirrup strap, said lower end including a tread extending laterally from said side piece, the tread terminating in an unsupported free end, a dome connected to said free end and extending upwardly therefrom, said dome including a forward portion extending forwardly of said tread and a middle portion connected directly to said forward portion, said forward portion having a front surface curving smoothly away from said tread and a top surface curving smoothly away from said tread, said middle portion having a top surface curving smoothly away from said tread, a retaining strap releasably connected at one end to said dome, a safety link releasably anchoring the other end of said retaining strap relative to the upper end of said side piece, said safety link including a projecting member and an apertured receiving member for receiving said projecting member, said projecting member including a plurality of transverse ribs, said apertured receiving member containing a plurality of transverse recesses for cooperation with said ribs one of said members being supported form said retaining strap and the other of said members being anchored to said stirrup strap.

2. The stirrup defined claim 1 wherein said dome further includes a rear portion which has a rear surface curving smoothly away from said tread and a top surface curving smoothly away from said tread.

3. The stirrup of claim 2 and further wherein said forward portion is curved downwardly in relation to said tread.

4. The stirrup defined in claim 3 and further including an indentation formed in said middle portion of the side of said dome, for conforming to the boot of a rider.

5. The stirrup defined in claim 1 wherein said projecting member comprises said one member and said one end of said retaining strap is pivotally attached to said dome.

6. A stirrup having a side piece including an upper end and a lower end, said upper end being connected to a stirrup strap, said lower end including a tread extending laterally from said side piece, the tread terminating outwardly in an unsupported free end, a retaining strap releasably connected at one end to said free end, a safety link releasably anchoring the other end of said retaining strap proximate to the upper end of said side piece, said safety link including a projecting member and an apertured receiving member for receiving said projecting member, said projecting member including a plurality of transverse ribs, said apertured receiving member containing a plurality of transverse recesses for cooperation with said ribs, one of said members being connected proximately to said upper end of said side piece and the other said members being connected to said other end of said retaining strap.

* * * * *